United States Patent [19]

Yang

[11] Patent Number: 4,949,844

[45] Date of Patent: Aug. 21, 1990

[54] A GOLF BAG HAVING PIVOTABLE SUPPORT

[76] Inventor: Fu-Hsiung Yang, No. 158-1, 3rd Floor, Chao-Chou St., Taipei, Taiwan

[21] Appl. No.: 325,171

[22] Filed: Mar. 17, 1989

[51] Int. Cl.[5] ..... A63B 55/00; A63B 55/06

[52] U.S. Cl. ..... 206/315.7; 206/315.3; 206/315.6; 248/96

[58] Field of Search ..... 206/315.6, 315.3, 315.7, 206/315.8, 315.2; 248/96; 211/70.2

[56] References Cited

U.S. PATENT DOCUMENTS

| | | | |
|---|---|---|---|
| 857,124 | 10/1958 | Howe | 248/96 |
| 1,320,620 | 11/1919 | Jenson | 248/96 |
| 1,738,242 | 12/1929 | Gunther | 248/96 |
| 1,790,092 | 1/1931 | Duguid et al. | 248/96 |
| 1,895,454 | 1/1933 | Ducat | 248/96 |
| 2,186,491 | 1/1940 | Meyer | 206/315.7 |
| 2,327,736 | 8/1943 | Pearson | 206/315.7 X |
| 2,436,687 | 2/1948 | Corbett | 206/315.6 |
| 2,436,688 | 2/1948 | Corbett | 206/315.3 |
| 2,571,088 | 10/1951 | Walton | 248/96 |
| 2,846,170 | 8/1958 | Huber | 248/96 |
| 2,857,124 | 10/1958 | Howe | 248/96 |
| 4,667,820 | 5/1987 | Solheim | 206/315.6 |
| 4,685,561 | 8/1987 | Reimers | 206/315.7 X |
| 4,778,136 | 10/1988 | Reimers | 206/315.7 X |
| 4,834,235 | 5/1989 | Solheim et al. | 206/315.7 |

FOREIGN PATENT DOCUMENTS

| | | | |
|---|---|---|---|
| 3942 | 8/1932 | Australia | 206/315.6 |
| 105469 | 10/1938 | Australia | 242/96 |
| 689509 | 9/1930 | France | 206/315.6 |
| 11777 | 2/1896 | United Kingdom | 206/315.6 |
| 18267 | 11/1908 | United Kingdom | 206/315.6 |
| 591224 | 8/1947 | United Kingdom | 248/96 |

OTHER PUBLICATIONS

"Sun Mountain Sports" Catalogue, dated 1988.

*Primary Examiner*—Sue A. Weaver
*Attorney, Agent, or Firm*—Armstrong, Nikaido, Marmelstein, Kubovcik & Murray

[57] ABSTRACT

A golf bag device includes a supporter not connected to the shoulder pad in order that the supporter not only can securely stand the bag portion in a first stored position and a second use position but also enables the bag device not to have too relatively large a bulk. The bag device also includes a top collar being stepped in height in order that to get/put the club from/in the bag portion is facilitated.

5 Claims, 3 Drawing Sheets

GOLF BAG HAVING PIVOTABLE SUPPORT

BACKGROUND OF THE INVENTION

The present invention relates to a golf bag device, and more particularly to a support mechanism therefor.

U.S. Pat. No. 4,685,651 issued to Eric W. Reimers on Aug. 11, 1987 discloses a golf bag device which includes a pair of support members connected to the bag strap and the shoulder pad through a transverse member slidable around the intermediate portions of the support members by slidable clamps, and a guide and restraining posts on the collar being both provided for guiding the support members. Restraining posts can lock the bag portion and the support members in a stable relative use position and must be released if one wants the support members to match against the bag portion when the bag device is to be carried. If the transverse member is made of hard material, the bag device will have a relatively large size which is disadvantageous without further explanation. If the transverse member is made of relatively soft material, the support members will get loosened when restraining posts are released so that the bag device cannot stand by itself anymore since the base plate is inclined with respect to the longitudinal axis of the bag portion and thus the bag device can only stand against a wall or by means of another supporter which is also disadvantageous.

It is therefore attempted by the Applicant to deal with the above disadvantageous encountered by the prior art.

SUMMARY OF THE INVENTION

It is therefore an object of the present invention to provide a golf bag device capable of having a reduced bulk in a storage position.

It is further an object of the present invention to provide a golf bag device capable of standing by itself at any time.

It is additional an object of the present invention to provide a golf bag device having a collar being stepped in height in order to facilitate the operations of getting-/putting the club from/in the bag portion.

It is yet an object of the present invention to provide a golf bag device being relatively light when compared with the other bag device having a support mechanism.

According to the present invention, a golf bag device includes a bag portion having a closed base plate and an open top collar, a base piece secured to the bag portion, and a supporter pivotally mounted to the base piece and capable of securely standing the bag portion in a first storage position and a second use position.

The bag portion often includes therein a plurality of club storage compartments and the collar can be stepped in height in order that to get/put the club from-/in the bag portion is facilitated.

The base plate can be a plate not perpendicular to the longitudinal axis of the bag portion, but can alternatively include a portion perpendicular to the longitudinal axis so that the bag portion can stand at the first or second position more securely.

The present invention may best be understood through the following descriptions with reference to the accompanying drawings, in which:

DETAILED DESCRIPTION OF THE PREFERRED EMBODIMENT

Figure 1:
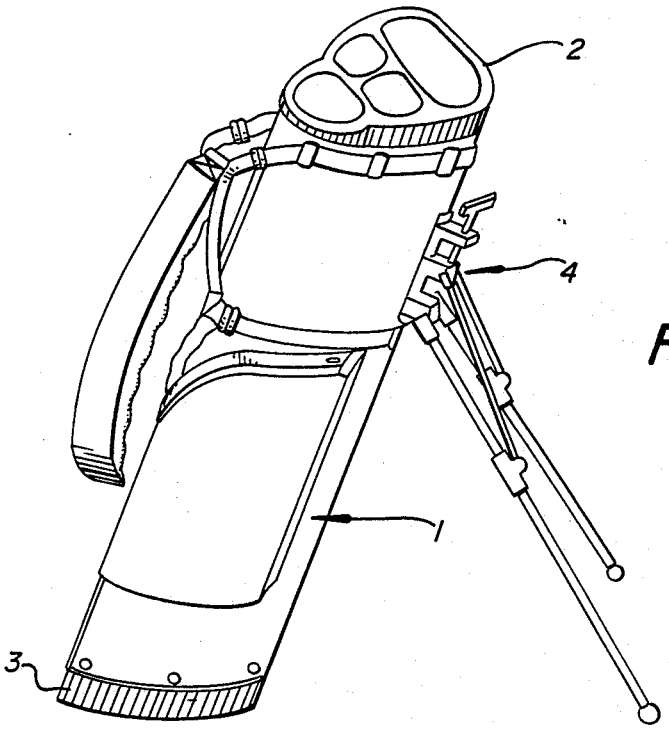
FIG. 1 is a perspective view showing a preferred embodiment of a golf bag device according to the present invention in a use position.
Figure 2:
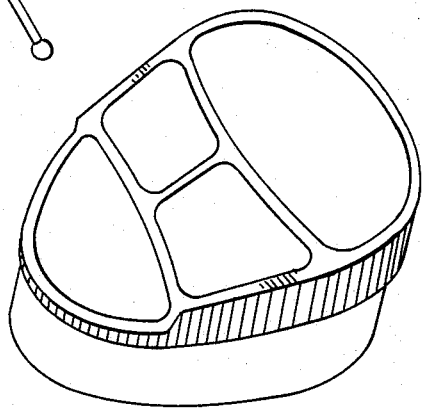
FIG. 2 is an oblique view showing a collar for a bag device in FIG. 1.
Figure 3:
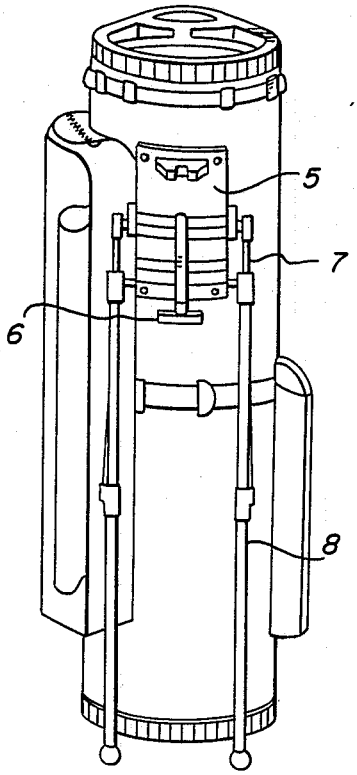
FIG. 3 is a rear view showing a golf bag device in FIG. 1 in a storage position.
Figure 4:
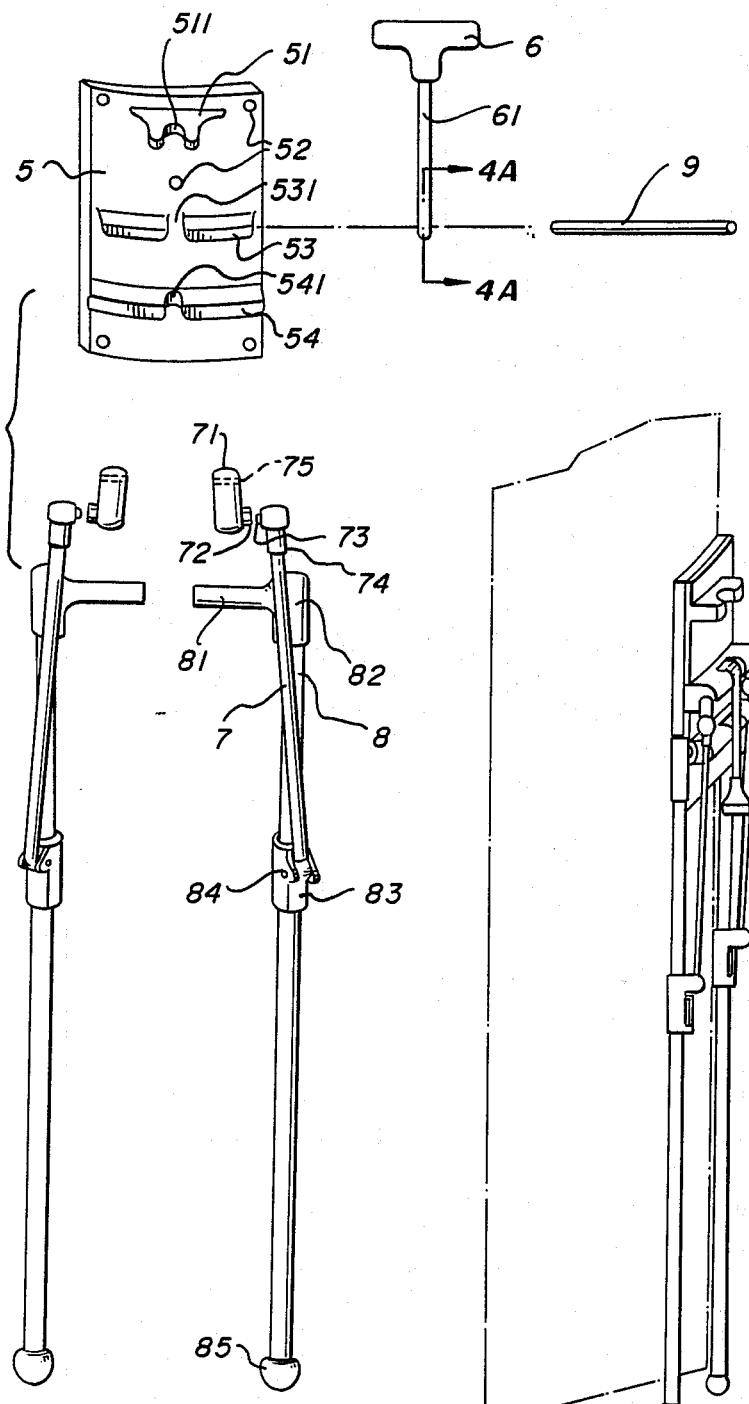
FIG. 4 is an exploded view showing a supporter of a golf bag device in FIG. 1.
Figure 4A:
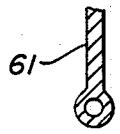
FIG. 4A is a sectional view showing an engaging end of a hande of a bag device in FIG. 1.

Referring now to FIGS. 1–4A, a golf bag device according to the present invention includes a bag portion 1 having a plurality of club storage compartments, a closed bottom end formed with a base plate 3 and an open top end attaching thereto a collar 2 being suitably stepped in height in a manner, for example, as shown in FIG. 2, in order that to get/put a club from/in bag portion 1 is facilitated. Bag portion 1 can further includes a bag strap, a shoulder pad and two side longitudinal pockets capable of storing therein (e.g.) golves.

The present golf bag device further includes a supporting means 4 having a base piece 5 and a supporter (6, 7, 8) which includes a handle 6, two connecting rods 7 and two support members 8 and their other relevant elements to be described now. Base piece 5 can be made of plastic and includes holes 52 through which fastening media can pass to secure piece 5 to bag portion 1, and an upper, an intermediate and a lower seats 51, 53 and 54 respectively each having a middle U-shaped groove 511, 531 and 541 respectively in which each of seats 53 and 54 includes a longitudinal hole not shown. Handle 6 includes a rod body 61 made of e.g. aluminum and having a lower engaging end having a hole, and an upper end having a grip suitably shaped to be capable of being easily gripped by a user's hand. Support members 8 includes two L-shaped top inserts 82 having horizontal pieces 81 pivotally fixed in the longitudinal hole of lower seat 54, two sleeve members 83 respectively secured to the intermediate portions of support members 8 and having pinholes 84, and two bottom ball pads 85 relatively uneasy to slide on any kind of contacting surface.

Figure 5:
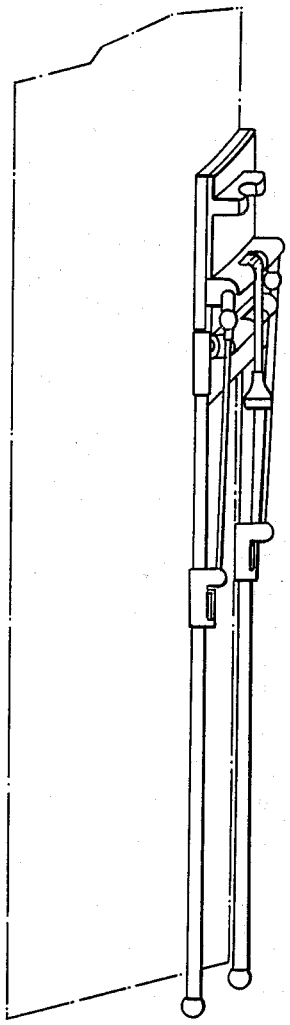
FIG. 5 is a schematically side view showing a golf bag device of FIG. 1 in a storage position with the supporter thereof matching against the bag portion.
Figure 6:
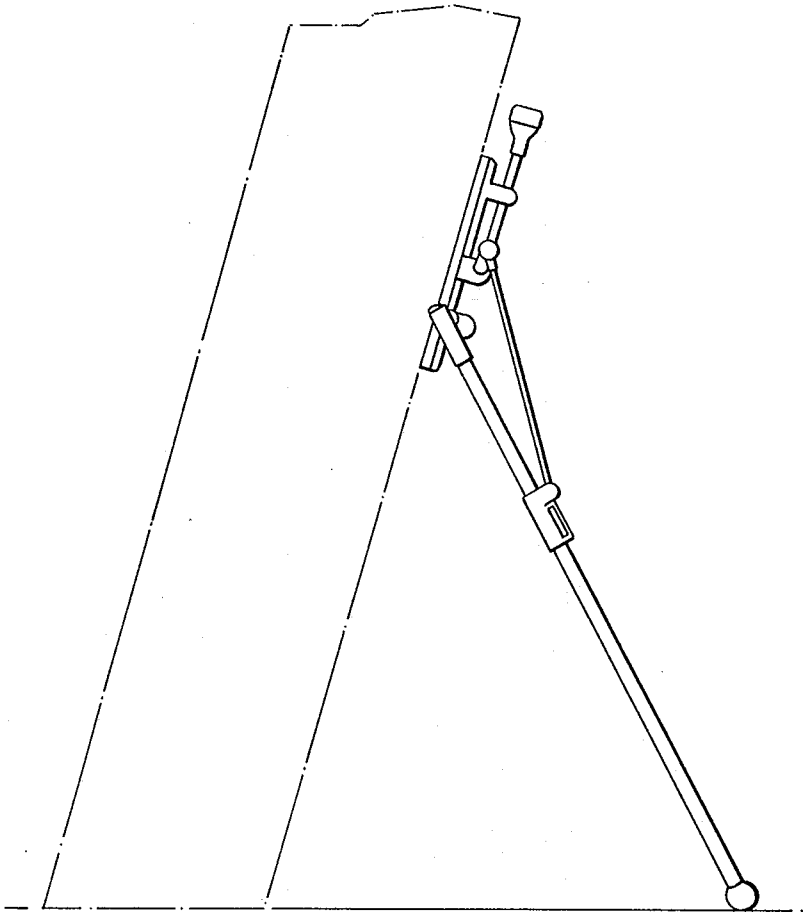
FIG. 6 is a schematically side view showing a golf bag device in FIG. 1 in a use position.

Each of connecting rods 7 can be made of plastic and has a bottom end pivotally connected to a respective sleeve member 83 by a pin pinning therethrough, and a top end attaching thereto an insert 74 having an upper portion rotatably fixing thereto a spherically headed bolt 73 threadedly engaging thereto by means of a nut 72 a first end of an elliptical connector 71 having a second opposite end having a hole 75. A pin 9 rotatably mounted in the longitudinal hole of intermediate seat 53 non-rotatable pins through holes 75 of connectors 71 and handle 6 having the lower end thereof positioned in U-shaped groove 531 in the manner that when handle 6 is upwardly (downwardly) pivoted to have the free end thereof retained in upper (lower) U-shaped grooves 511 (541) to position hole 75 below (above) bolt 73 as shown in FIG. 6 (FIG. 5), the present golf bag device is in a use (storage) position.

Figure 7:
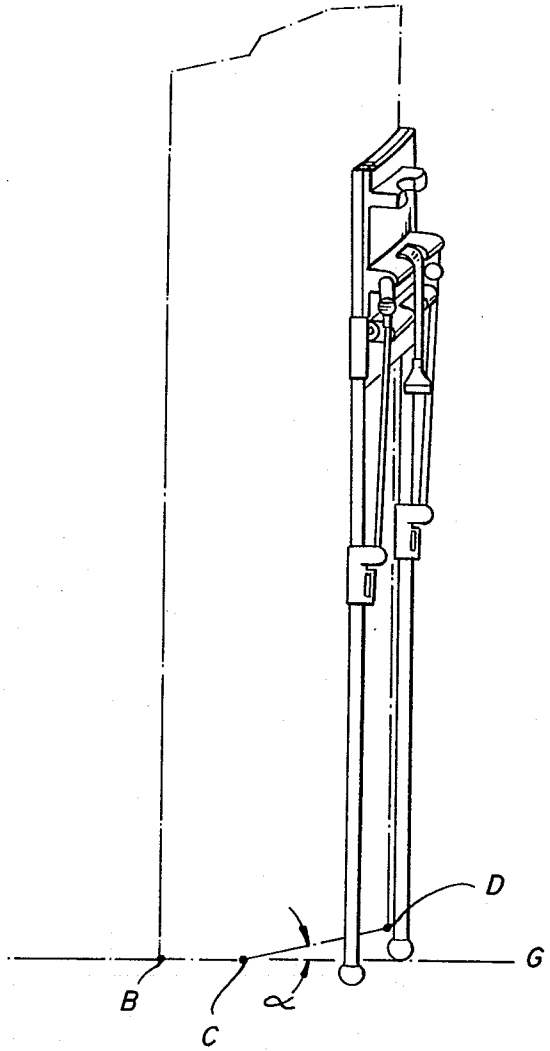
FIG. 7 is a schematically side view showing an alternate embodiment of a golf bag device according to the present invention in a storage position.

Shown in FIG. 7 is an alternate embodiment of the golf bag device according to the present invention. As shown in FIG. 7, when the golf bag stands on the ground G, the portion B-C of the base plate which is perpendicular to the longitudinal axis of the bag also sits well on the ground G, whereas the portion C-D of the base plate forms a sharp angle $\alpha$ with the ground G.

Through the structure described above, the present golf bag device can stand securely by itself whether it is in a storage or a use condition so that the club stored therein can be thus prevented from being damaged, and the user is prevented from being hurt through the inadvertent fall of the bag device.

Numerous modifications and changes made to the golf bag device above described can be effected without departing from the scope or the spirit of the present invention. For example, the number of the side pocket can be decreased or increased. The base plate 3 can be wholly not perpendicular to the longitudinal axis of the bag portion 1 but can alternatively be partly perpendicular and partly not perpendicular to the longitudinal axis. Thus, the invention is not to be limited to the disclosed embodiment but on the contrary, is intended to cover various modifications and equivalent arrangements included within the spirit and scope of the appended claims and its scope is to be accorded the broadest interpretation so as to encompass all such modifications and equivalent structures.

While the invention has been particularly shown and described in reference to preferred embodiments thereof, it will be understood by those skilled in the art that changes in form and details may be made therein without departing from the spirit and scope of the invention.

What I claim is:

1. A golf bag device comprising:

a bag means for storing therein at least a club, and having a closed bottom end portion formed with a base plate, an open top end portion, and a collar attached to said open top end portion;

a base means secured to said bag means; and a support means pivotally mounted to said base means for securely standing said bag means in a first stored position and in a second use position, wherein said base means is for pivotally supporting said support means onto said bag means, said support means including connector means and leg means, said connector means having a top end operably connected to said base means and a bottom end operably connected to said leg means, wherein said base means includes an upper seat, an intermediate seat and a lower seat, each seat having a substantially U-shaped groove, wherein said support means further includes a handle means having an engaging end, and a free end retained in one of said upper and lower substantially U-shaped grooves, wherein said leg means has at least two leg support members, each leg support member having an upper end pivotally mounted to said lower seat, wherein said connector means has at least two connecting rods, each connecting rod having a bottom end pivotally connected to one of said leg support members and a top end, wherein said connector means further has at least two connectors, each connector having a first end rotatably connected to said top end of one of said connecting rods, and a second end positioned above or below said first end when said first end is rotated around said top end of said one of said connecting rods; and a pin rotatably mounted in said intermediate seat and pinning together said engaging end of said handle means and said second ends of said connectors.

2. A golf bag device according to claim 1, wherein said bag means includes therein a plurality of club storage compartments and said collar is stepped in height to thereby facilitate putting said club into and taking out said club from said bag means.

3. A golf bag device according to claim 1, wherein said base plate includes a first portion which is other than perpendicular to a longitudinal axis of said bag means.

4. A golf bag device according to claim 3, wherein said base plate further includes a second portion which is perpendicular to said longitudinal axis.

5. A golf bag device comprising:

a bag means for storing therein at least a club, and having a closed bottom end portion formed with a base plate, an open top end portion, and a collar attached to said open top end portion;

a support means for securing said bag means in a stored position and in a use position, wherein said securing means includes:

(a) base means having an upper seat, an intermediate seat and a lower seat, each seat having a substantially U-shaped groove, (b) at least two leg support members, each leg support member having an upper end pivotally mounted to said lower seat, (c) at least two connecting rods, each connecting rod having a bottom end pivotally connected to one of said support members and a top end, and (d) at least two connectors, each connector having a first end rotatably connected to said top end of one of said connecting rods, and a second end positioned above or below said first end when said first end is rotated around said top end of said one of said connecting rods; and a locking means for locking said support means and for securing said support means when said bag means is in said use position, and for unlocking said support means when said bag means is in said stored position, said locking means having a handle means with an engaging end and a free end retained in one of said upper and lower substantially U-shaped grooves, and a pin rotatably mounted in said intermediate seat for pinning together said engaging end of said handle means and said second ends of said connectors.

* * * * *